United States Patent [19]

Gladek

[11] 4,246,708

[45] Jan. 27, 1981

[54] SPORT SHOE, ESPECIALLY FOR CROSS-COUNTRY SKIING AND TENNIS

[75] Inventor: Janez Gladek, Hergiswil, Switzerland

[73] Assignee: "Montana-Research" Müller and Co., Hergiswil, Switzerland

[21] Appl. No.: 78,065

[22] Filed: Sep. 24, 1979

[30] Foreign Application Priority Data

Dec. 14, 1978 [CH] Switzerland ..... 12705/78

[51] Int. Cl.[3] ..... A43B 23/00; A43B 5/04; A43B 13/12

[52] U.S. Cl. ..... 36/107; 36/30 R; 36/117

[58] Field of Search ..... 36/30 R, 31, 32 R, 117, 36/118, 119, 120, 121, 107

[56] References Cited

U.S. PATENT DOCUMENTS

| | | | |
|---|---|---|---|
| 3,613,270 | 10/1971 | Eie | 36/30 R |
| 4,102,063 | 7/1978 | Ihlen | 36/117 |
| 4,106,223 | 8/1978 | Benseler | 36/117 |
| 4,108,467 | 8/1978 | Kreyenbuhl | 36/117 |
| 4,174,121 | 11/1979 | Benseler | 36/117 |

*Primary Examiner*—Patrick D. Lawson
*Attorney, Agent, or Firm*—Werner W. Kleeman

[57] ABSTRACT

An athletic or sport shoe, for instance a cross-country skiing shoe or a tennis shoe is disclosed, which has a sole formed of, for instance, polyurethane which is molded at the upper portion of the shoe. In the material of the polyurethane sole there is molded a resilient or spring plate, formed of a suitable metal or plastic. The resilient plate is provided at its front region with flange means serving as support or contact means for the ski binding jaw or the like and holes or perforations for the binding pins or mandrils. The resilient plate extends over essentially the entire length of the shoe sole and is only visible through its flanges at the sole edges. The plate is structured such that at the region of the ball of the foot it is easier to resiliently bend while at the region of the shoe stiffener it is practically hardly resiliently bendable, so that the rolling-off of the foot is possible practically without any hinderance, but the foot is supported laterally and against torsion.

11 Claims, 4 Drawing Figures

SPORT SHOE, ESPECIALLY FOR CROSS-COUNTRY SKIING AND TENNIS

BACKGROUND OF THE INVENTION

The present invention relates to a new and improved construction of athletic or sport shoe, especially for cross-country skiing and tennis and which is of the type having a sole which is molded or otherwise formed at the upper portion or part of the shoe. In the context of this disclosure the term "shoe" is used in its broadest sense to encompass not only shoes as such but also boots and other similar type of footwear.

Such type athletic or sport shoes, especially cross-country skiing shoes or the like, should have a shoe sole which is as light and flexible as possible, so that there is not hindered the rolling-off action of the user's foot. However, they also should provide good support for the user's foot in a direction transversely with respect to the roll-off direction and should prevent to the extent possible any lateral deviation or torsion of the foot. With the heretofore known shoes it is hardly possible to realize the foregoing. Even the most modern shoes, possessing a sole which is molded at the upper part of the shoe and having a front cap and a rear cap, can only partially fulfill these requirements. The same situation prevails in the case of tennis shoes.

SUMMARY OF THE INVENTION

Therefore, with the foregoing in mind it is a primary object of the present invention to provide a new and improved construction of sport shoe of the character described which is not afflicted with the aforementioned drawbacks and limitations of the prior art constructions.

Still another significant object of the present invention aims at a new and improved construction of athletic shoe or the like which is relatively simple in design, economical to manufacture, and affords good lateral support for the user's foot and adequate resistance against the action of torsional forces.

Another and more specific but extremely important object of the present invention relates to a new and improved construction of sport shoe, especially for cross-country skiing, which provides for the user's foot satisfactory lateral support, sufficient resistance against torsion and still enables relatively free roll-off of the user's foot.

Now in order to implement these and still further objects of the invention, which will become more readily apparent as the description proceeds, the sport shoe of the present development is manifested by the features that there is embedded in the shoe sole an at least partially spring-elastic or resiliently elastic plate which extends approximately over the entire length of the sole.

The at least partially resiliently or spring elastic plate, embedded in the sole material, extending almost over the entire lengthwise region of the sole, from the shoe tip up to the heel, can appreciably increase the torsional resistance of the sole and its lateral stability, while still hardly hindering the rolling-off of the user's foot.

The plate, in the case of cross-country skiing shoes, should possess the bores or holes for the binding parts which are normally provided at the shoe sole, in order to increase its effect and which are also useful, during the fabrication of the shoe or boot, for the centering of the sole and plate.

At the front region the resilient plate should extend at least up to the lateral sole edge, so that it can come into guiding contact with the jaws or the like of a ski binding. The thus realized effect can be augmented by the provision of lateral flanges at the plate, which additionally can serve as a protection against wear. To prevent that the flexibility of the sole is not improperly impaired by the flange it can be provided with transverse slots or cutouts or the like.

In order to be able to elevationally center the plate in the shoe sole during fabrication of the shoe, the plate advantageously should be provided at its surfaces with appropriate projections or protuberances which, at the finished shoe, extend up to the surfaces of the sole. In this way it is possible to dispense with the use of appropriate centering pins in the mold, which furthermore would lead to the formation of holes.

The plate or plate member advantageously possesses over its length zones or regions of different degrees of flexibility. At the region of the ball of the foot it should be easily flexible and at the region of the shoe stiffener it should be at the very least quite difficult to flex. This can be obtained by appropriately configuring the plate and/or by appropriately selecting its dimensions. Thus, for instance, if the plate is a metallic plate then it can be provided with holes or perforations at the region of the ball of the foot and can be provided with ribs or corregations at the region of the shoe stiffener. Suitable as a metallic plate is an aluminium alloy plate, although other metals can be employed. In analagous manner the plates can be formed of other materials, for instance from plastic materials, such as an epoxy resin or polyester, with or without reinforcements, and the dimensions in the width and thickness can be decisive as can also be the reinforcement of such plates.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
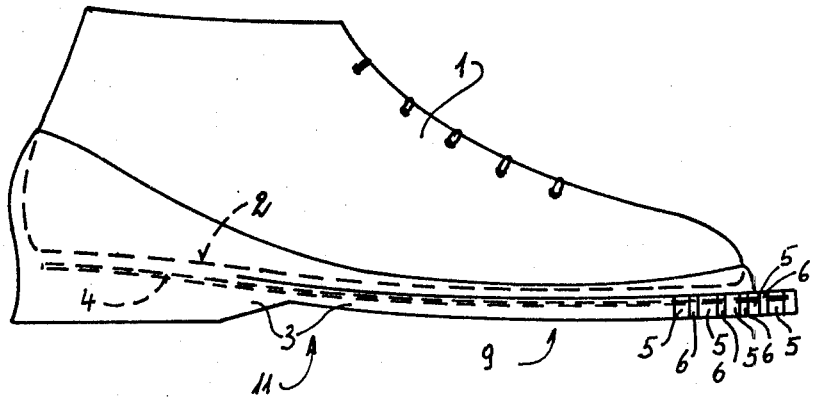
FIG. 1 is a side view of a sport or athletic shoe according to the invention, here shown as a cross-country skiing shoe.

Describing now the drawings, in FIG. 1 there will be recognized an exemplary embodiment of athletic or sport shoe, here shown by way of example as a cross-country skiing shoe, containing an upper shoe portion 1 which extends up to the region of the broken lines 2 where, not taking into account an intermediate sole and the like, there starts the upper surface of the shoe sole 3, formed for instance of polyurethane, and enclosing the shoe heel as well as a front and rear cap. In the sole material there is molded or otherwise embedded a plate or plate member 4 whose front edge flange or flange means 5 is interrupted by slots or cutouts 6 or equivalent structure. The slotted flange means extends by means of its outer surface up to the not particularly designated side edge of the shoe sole and serve as a support or contact means for the ski binding jaw means, whereas for the mandrils or pins of the ski binding there are provided the holes or apertures 7 in the tip or toe portion of the plate member or plate 4.

Figure 2:
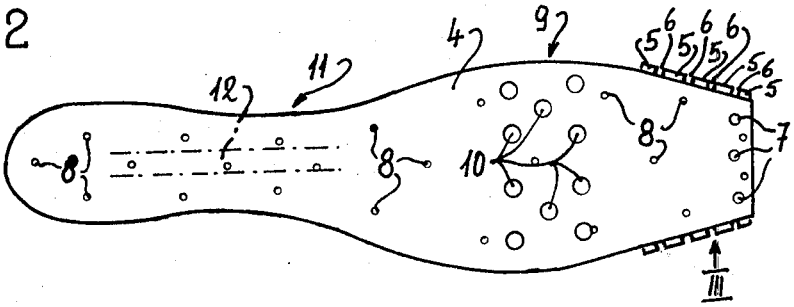
FIG. 2 is a top plan view of a plate of the shoe sole of such cross-country skiing shoe.
Figure 3:
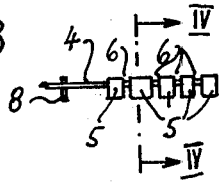
FIG. 3 is a view of the plate of FIG. 2, looking in the direction of the arrow III.

Further, it will be seen by referring to FIGS. 2 and 3 that pins 8, provided at both surfaces, i.e. the top and bottom surfaces of the plate 4 serve for centering such plate during molding of the shoe sole 3.

Holes or apertures 10 are provided at the region of the ball of the foot, generally indicated by reference character 9, as best seen by referring to FIG. 2, in order to weaken the plate 4 at such location, so that it is more flexible at this region of the ball of the foot than in the unperforated regions of such plate 4, without having to reduce the plate width. A narrower plate would of course have less transverse rigidity or stiffness.

In order to make stiffer the stiffener region 11 of the plate 4 there can be provided, as schematically shown in broken lines, corregations or undulated ribs 12.

The plate 4 can be accommodated to the extent needed in the lengthwise and transverse direction three-dimensionally to the form of the user's foot. In this manner it is possible to fulfill the previously incompatible requirements at a cross-country skiing shoe.

Figure 4:
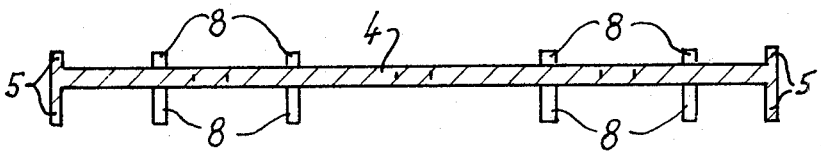
FIG. 4 is an enlarged and extended sectional view of the plate, taken substantially along the line IV—IV of FIG. 3.

When employing the invention with other types of athletic shoes, particulary in the case of tennis shoes, it is possibly advantageous if the plate has at its front and rear portions a flange for taking-up thrust forces and tensional forces, which flanges preferably extend upwardly and which can be similar to the described side flanges 5 of the showing of FIG. 4.

While there are shown and described present preferred embodiments of the invention, it is to be distinctly understood that the invention is not limited thereto, but may be otherwise variously embodied and practised within the scope of the following claims. Accordingly,

What I claim is:

1. A sport shoe, especially for cross-country skiing and tennis, comprising:

an upper portion and a sole formed at the upper portion;

an at least partially resiliently elastic plate embedded in said sole;

said plate extending approximately over the entire length of the sole;

said sole having a tip region; and said plate having bores at the tip region of the sole for the reception of parts of a ski binding.

2. The sport shoe as defined in claim 1, wherein:

said plate has a front region; and said plate extending at its front region at least up to the edge of the sole.

3. The sport shoe as defined in claim 2, wherein:

said plate includes lateral flange means at its front region; and said lateral flange means extending at least up to the sole edge.

4. The sport shoe as defined in claim 3, wherein:

said flange means include slot means extending transversely with respect to the plane of said plate.

5. A sport shoe, especially for cross-country skiing and tennis, comprising:

an upper portion and a sole formed at the upper portion;

an at least partially resiliently elastic plate embedded in said sole;

said plate extending approximately over the entire length of the sole; and said plate is provided with at least one centering projection at one of its surfaces, which centering projection extends up to a corresponding sole surface and serves to center said plate during embedding of said plate in said sole.

6. A sport shoe, especially for cross-country skiing and tennis, comprising:

an upper portion and a sole formed at the upper portion;

an at least partially resiliently elastic plate embedded in said sole;

said plate extending approximately over the entire length of the sole; and said plate is structured so as to possess over its length portions having different flexibility.

7. The sport shoe as defined in claim 6, wherein:

said plate is more flexible at the region of the ball of the foot than at other regions.

8. The sport shoe as defined in claim 7, wherein:

said plate is provided with holes at the region of the ball of the foot.

9. The sport shoe as defined in claim 6, wherein:

said plate includes a shoe stiffener portion provided with means for stiffening said shoe stiffener portion.

10. The sport shoe as defined in claim 6, wherein:

said plate is at least partially formed of a resilient aluminium alloy.

11. The sport shoe as defined in claim 6, wherein:

said plate is formed at least partially of plastic material.

* * * * *